US005092982A

United States Patent [19]

Becraft

[11] Patent Number: 5,092,982

[45] **Date of Patent: * Mar. 3, 1992**

[54] MANUFACTURE OF ISOTROPIC COKE

[75] Inventor: Lloyd G. Becraft, Ponca City, Okla.

[73] Assignee: Conoco, Inc., Ponca City, Okla.

[ * ] Notice: The portion of the term of this patent subsequent to Nov. 19, 2008 has been disclaimed.

[21] Appl. No.: 628,544

[22] Filed: Dec. 14, 1990

[51] Int. Cl.[5] ..... C10G 9/14

[52] U.S. Cl. ..... 208/131; 208/50

[58] Field of Search ..... 208/131, 50

[56] References Cited

U.S. PATENT DOCUMENTS

| | | | |
|---|---|---|---|
| 2,922,755 | 1/1960 | Hackley | 208/39 |
| 3,112,181 | 11/1963 | Petersen et al. | 23/209.1 |
| 3,956,101 | 5/1976 | Hara et al. | 208/50 |
| 3,960,704 | 6/1976 | Kegler et al. | 208/50 |
| 3,966,585 | 6/1976 | Gray et al. | 208/8 |
| 4,235,703 | 11/1980 | Kegler et al. | 208/131 |
| 4,624,775 | 11/1986 | Dickinson | 208/131 |
| 4,740,293 | 4/1988 | Dickinson et al. | 208/131 |
| 4,832,823 | 5/1989 | Goyal et al. | 208/50 |

*Primary Examiner*—Theodore Morris
*Assistant Examiner*—Mary C. DiNunzio

[57] ABSTRACT

Low sulfur isotropic coke is produced by the delayed coking of a mixture of a pyrolysis tar and a residual oil which has been solvent extracted to remove paraffinic components and then air-blown.

7 Claims, 1 Drawing Sheet

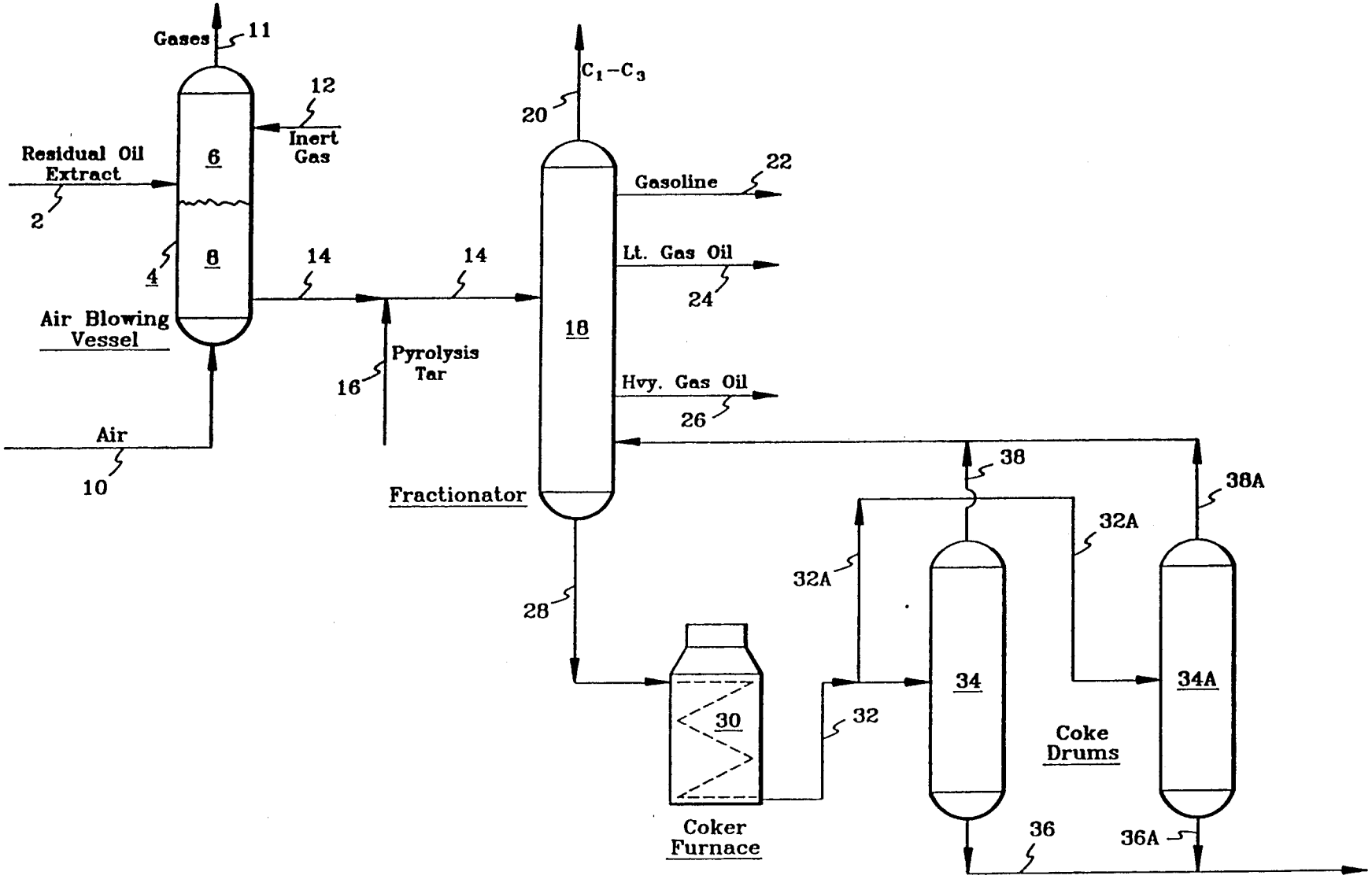
Gases
11
12
Inert Gas
6
8
4
Residual Oil Extract
2
Air Blowing Vessel
Air
10
14
14
Pyrolysis Tar
16
$C_1-C_3$
20
18
Gasoline
22
Lt. Gas Oil
24
Hvy. Gas Oil
26
Fractionator
28
38
38A
32A
32A
34
34A
Coke Drums
36
36A
32
30
Coker Furnace

MANUFACTURE OF ISOTROPIC COKE

BACKGROUND AND SUMMARY OF THE INVENTION

Isotropic coke has a thermal expansion approximately equal along the three major crystalline axes. This thermal expansion is normally expressed as CTE (i.e. coefficient of thermal expansion) over a given temperature range such as 30°-530° C. or 30°-100° C. Isotropic coke is also indicated by a CTE ratio, which is the ratio of radial CTE divided by axial CTE measured on a graphitized extruded rod. Acceptable isotropic coke has a CTE ratio of less than about 1.5 or a CTE ratio in the range of about 1.0.1.5.

Isotropic coke is used to produce hexagonal graphite logs which serve as moderators in high temperature gas-cooled nuclear reactors. This type of coke has been produced in the past from natural products such as gilsonite. The production of such graphite logs from gilsonite and the use thereof are described in U.S. Pat. Nos. such as 3,231,521 to Sturges; 3,245,880 to Martin et al; and 3,321,375 to Martin et al. U.S. Pat. No 3,112,181 to Peterson et al describes the production of isotropic coke using petroleum distillates. Contaminants such as boron, vanadium, and sulfur have prohibited the use of some materials as the source of isotropic coke suitable for use in nuclear reactors. Less than about 1.6 weight percent sulfur is preferred to avoid puffing problems upon graphitization and fabrication of the coke. The supply of isotropic coke has been limited by availability of source materials such as gilsonite and expensive petroleum distillates.

U.S. Pat. No. 3,960,704 describes a process in which a residuum, such as bottoms from the fractionation of virgin feedstocks, is air-blown to increase its softening point. The air-blown resid is then subjected to delayed coking to produce isotropic coke having a CTE ratio less than 1.5.

Residual oils vary substantially in their sulfur content, from less than 1.0 wt % to as high as 4.5 wt % or higher. When residual oils are subjected to coking the amount of sulfur in the resultant coke is from about 1.3 to about 1.5 times as much as the sulfur in the residual oil feedstock. Since it is desirable to obtain an isotropic coke product containing a minimum amount of sulfur, low-sulfur air-blown residual oils are preferred as coker feedstocks; but these oils are limited in supply and are more expensive than higher sulfur feeds.

In accordance with this invention a low-sulfur pyrolysis tar is combined with a residual oil of greater sulfur content which has been solvent extracted to remove paraffinic components and thereafter contacted with an oxygen-containing gas at an elevated temperature to increase its softening point and the combined material is subjected to delayed coking to provide an isotropic coke product having a low CTE ratio and reduced sulfur content.

PRIOR ART

U.S. Pat. No. 4,624,775 to Dickinson describes a process for making a premium coke from a mixture of pyrolysis tar that is low in sulfur content and coal tar distillate, heating the mixture and then subjecting the mixture to delayed coking to produce premium coke.

U.S. Pat. No. 3,966,585 to Gray et al describes a process for the production of coke from coal extract.

U.S. Pat. No. 3,112,181 to Peterson et al describes the production of isotropic coke for use in the manufacture of moderators employed in nuclear reactors. The coker feedstock used is petroleum distillate which has been oxygen treated.

U.S. Pat. No. 2,922,755 to Hackley describes a process wherein reduced crude can be mixed with thermal tar to produce a mixture for producing higher yields of premium coke by delayed coking.

U.S. Pat. No. 3,960,704 describes a process in which a residuum, such as bottoms from the fractionation of virgin feedstocks, is air-blown to increase its softening point. The air-blown resid is then subjected to delayed coking to produce isotropic coke having a CTE ratio less than 1.5.

BRIEF DESCRIPTION OF THE DRAWING

The drawing is a schematic diagram of a process unit which illustrates the process of the invention.

DETAILED DESCRIPTION OF THE INVENTION

The pyrolysis tar used in the process of the invention may be any tar produced by high temperature thermal cracking in pyrolysis furnaces to produce low molecular weight olefins. In general olefins comprising primarily ethylene and lesser amounts of propylene butene, and isobutylene are produced by the severe cracking of petroleum distillates or residues at temperatures from about 1200° to about 1800° F., preferably from about 1300° to about 1600° F., at pressures from atmospheric to about 15 psig and in the presence of a diluent gas. Typical diluents employed are low boiling hydrocarbons such as methane, ethane, or propane, although steam is preferred and is the most commonly used diluent. Ethane and propane can also serve as the cracking stock. The products of the cracking operation are predominantly olefinic gases such as ethylene, propylene, and butene. A heavy pyrolysis tar is obtained from this cracking operation and is removed with the effluent and separated by condensation.

Pyrolysis tars obtained in this manner are characterized by having low sulfur contents, usually from less than 0.1 wt % to about 2 wt %. These tars also provide high yields of coke when subjected to conventional delayed coking.

The residual oils used in carrying out the process of the invention can generally be any residual oils which upon solvent extraction provide an extract having a reduced paraffinic content. Suitable residual oils are those which have not been subjected to extensive thermal or catalytic cracking. Desirable feedstocks are atmospheric or vacuum reduced crudes. Specially preferred feedstocks are obtained from lube crude oils which have been solvent extracted. The extracts from such solvent treatments are characterized by having a substantially reduced paraffinic oil content.

The extracts described above provide feedstocks, which when subjected to air-blowing and delayed coking, produce substantial yields of isotropic coke having a low CTE ratio, i.e. below 1.5. The sulfur content of the extracted residual oils will vary from about 1 wt % to about 2 wt %.

Solvent extraction of lube crude oils to obtain high viscosity index lubricating oils and other valuable lube and wax products is well known in the art and has been practiced for many years. The process basically involves subjecting the crude oil to solvent extraction to obtain a raffinate material high in paraffinic components, which is further processed to provide a variety of useful lube and wax products. A number of solvents have been used in the extraction process, the major ones being furfural, phenol and Duo-Sol, which is a dual solvent system of cresylic acids and propane. The specific operations and conditions employed in carrying out lube solvent extraction are well known in the art and do not form a part of this inventive process.

The aromatic/asphaltic residue from the solvent extraction is the extract, which has little value and is often disposed of in other refinery processes. As stated above, this extract after air-blowing, serves as the preferred material for mixing with pyrolysis tar in the process of the invention. Lube crudes generally are low in sulfur and yield low-sulfur residual oil. The solvent extraction process concentrates in the extract the sulfur present in the residual oil. However, the amount of sulfur in the extract still remains low, although it is much greater than the concentration of sulfur in the pyrolysis tars.

The amount of pyrolysis tar used in process will vary depending on the particular residual oil with which it is combined and the amount of sulfur in such residual oil and in the pyrolysis tar. Any amount of pyrolysis tar will provide the desired results, however the use of larger amounts is more effective in reducing the sulfur content of the isotropic coke product. Up to 35 wt % pyrolysis tar or more may be used in the mixture of pyrolysis tar and oxygen-treated residual oil, however the concentration of pyrolysis tar will usually constitute between about 15 and about 30 wt % of the mixture.

The mixture of pyrolysis tar and air-blown solvent-extracted resid is converted to isotropic coke by subjecting it to delayed coking. The manufacture of coke by delayed coking refers to the formation of coke in a coke drum, such as described in U.S. Pat. No. 2,922,755 to Hackley. The delayed coking process typically uses petroleum feedstock, such as residuum or a mixture of various petroleum fractions to produce petroleum coke.

Referring now to the drawing, a residual oil extract is introduced through line 2 to air-blowing vessel 4. Within this vessel there is maintained a body of liquid 8 which is blanketed with inert gas, provided in sufficient quantity to fill the vapor portion 6 of the air-blowing vessel. The inert gas, which may be steam, nitrogen, or other gas which is not reactive in the process is introduced to vapor space 6 through line 12. Air-blown resid is withdrawn from air-blowing vessel 4 through line 14 and gases which include the inert gas, air, and light hydrocarbons are removed overhead from the air-blowing vessel through line 11.

The air-blowing operation is substantially the same as that used for producing asphalt and may be a continuous or batch process. The residual oil extract charge is heated to a temperature of about 400° to 600° F. which is slightly below its flash point. Air introduced to air-blowing vessel 4 through line 10 is bubbled or blown through the residual oil at a rate of about 20 to about 100 standard cubic feet per minute per ton of residual oil. The residence time of the residual oil extract in air-blowing vessel 4 is controlled to provide a residual oil product having a softening point of about 120° F. to about 240° F. and preferably from about 140° F. to about 200° F. While air is the preferred blowing agent because of its availability and cost, other oxygen-containing gases such as oxygen-enriched air may also be used if desired. The residence time required to effect the air-blowing operation will depend on the residual oil extract which is used. However, the air blowing ordinarily will be completed over a period from about 2 to about 24 hours of residence time.

The hot air-blown residual oil extract leaving vessel 4 is combined with hot pyrolysis tar provided through line 16. The mixture of residual oil extract and pyrolysis tar is then introduced to fractionator 18 where it is combined with overhead vapors from coke drums 34 and **34*a*. Light gases $C_1$ to $C_3$ are removed overhead from the fractionator through line 20. Heavier materials such as gasoline and light gas oil are taken from the fractionator through lines 22 and 24 respectively. A mixture of residual oil extract, pyrolysis tar, and diluent heavy gas oil is removed from the bottom of fractionator 18 through line 28. The purpose of the diluent gas oil is to reduce the viscosity of the mixture and permit easier handling and pumping of the mixture to the delayed coking part of the process. The heavy gas oil which is part of the gaseous effluent from the coke drums does not substantially coke and therefore recycles through the system. The amount of such diluent provided in the residual oil extract-pyrolysis tar mixture may be controlled by varying the amount of heavy gas oil withdrawn from fractionator 18 through line 26**.

The mixture of residual oil extract, pyrolysis tar and heavy gas oil passes through line 28 and is introduced to coker furnace 30 wherein it is heated to temperatures in the range of 875° to about 975° F. at pressures of about atmospheric to about 250 psig and is then passed via line 32 to coke drums 34 and **34*a***. The coke drums operate on alternate coking and decoking cycles of about 8 to about 100 hours; while one drum is being filled with coke the other drum is being decoked. During the coking cycle each drum operates at a temperature between about 830° and about 950° F. and a pressure from about 15 to about 200 psig.

The overhead vapor from the coke drums is passed via lines 38 or **38*a* to fractionator 18 wherein it is separated into various fractions as previously described. The green coke which is removed from the coke drums through outlets 36 and 36*a*** is further processed (not shown) to produce hexagonal graphite logs which are used as moderators in high temperature, gas-cooled nuclear reactors. The manufacture of such rods involves a series of steps which include calcination, heating to remove volatile hydrocarbons, graphitization and densifying treatment. These steps which do not perform a part of the invention are described in detail in U.S. Pat. No. 3,112,181 to Peterson et al, which patent is incorporated herein by reference.

As shown in the drawing the residual oil extract and pyrolysis tar are fed into a fractionator from which a combined mixture of pyrolysis tar, residual oil extract and heavy gas oil is withdrawn as feed to the delayed coker. This type of operation is typical of a commercial unit. However, the mixture of pyrolysis tar and residual oil extract can be fed directly to a furnace and thereafter introduced to the coke drums. In the latter operation the diluent, if used, can be heavy gas oil obtained from the coking operation or another suitable diluent material.

The air-blowing operation is shown in the figure as a part of the continuous process. Air-blowing alternatively may be carried out as a batch operation, in which case the air-blown resid would be accumulated in a tank or holding vessel from which it could be introduced continuously to fractionator 18 or to coking furnace 38 as desired. As another alternative a plurality of batch air-blowing vessels could be provided whereby it would be possible to continuously supply air-blown product for further processing without intermediate storage.

The isotropic coke produced by the process of the invention has excellent quality, as indicated by a low CTE ratio usually less than about 1.5, and by low sulfur content, usually not greater than about 1.5 percent. The CTE can be measured by any of several standard methods. For the isotropic coke of this invention, the coke is crushed and pulverized, dried, and calcined to about 2,400° F. This calcined coke is sized so that about 50 percent passes through a No. 200 U.S standard sieve. The coke is blended with coal tar pitch binder, and a small amount of lubricant. The mixture is extruded at about 1,500 psig into electrodes of about three-fourths-inch diameter and about 5 inches long. These electrodes are heated slowly up to a temperature of about 850° C. and heat-soaked for two hours. After a slow cool-down period (8-10 hours), the baked electrodes are graphitized at approximately 3000° C. Test pieces are machined from the graphitized electrodes. The coefficient of thermal expansion of the test specimens is then measured in the axial and radial directions over the range of about 30°-130° C. heated at a rate of about 2° C. per minute. The CTE ratio, as used herein, is the ratio of the radial CTE to axial CTE of the graphitized electrodes.

When subjected to coking, the pyrolysis tar used in the process of the invention does not produce an isotropic product yet the combination of pyrolysis tar and air-blown residual oil extract when coked together yields as much as or a higher percentage of isotropic coke product than would be obtained from the air-blown residual oil extract alone. The process offers a number of advantages over coking a mixture of air-blown residual oil which has not been subjected to solvent extraction and pyrolysis tar. The solvent extraction step reduces the quantity of residual oil which needs to be air blown to produce coke isotropy. The coke yield from the air-blown residual oil extract is greater than that obtained from air-blown unextracted residual oil, thus more coke is produced from a given quantity of coker feed.

The following example illustrates the results obtained in carrying out the invention:

EXAMPLE

A vacuum resid derived from a Mid-Continent paraffinic crude was coked in a laboratory batch reactor at the following conditions:

Temperature: 840° F.
Pressure: 60 psig
Time: 8 hours

An extract derived by commercial Duo-Sol solvent extraction of vacuum resid from the same crude source was batch coked at the same conditions before and after laboratory air blowing. To reduce the sulfur content and increase yield of the product coke, a low-sulfur pyrolysis tar was blended with the air-blown extract in various proportions before coking. Properties of the feedstocks used in the various coking runs are given in Table 1. Results of the coking runs are shown in Table 2.

TABLE 1

| | Vacuum Resid | Extract | Air-blown Extract | Pyrolysis Tar |
|---|---|---|---|---|
| ° API | 19 | 11 | 6.5 | −3 |
| Sulfur, wt % | 0.43 | 0.69 | 0.72 | 0.17 |
| Carbon Residue, wt % | 6.9 | 14 | 24 | 30 |

TABLE 2

| Run | 1 | 2 | 3 | 4 | 5 | 6 |
|---|---|---|---|---|---|---|
| Feedstock Composition, wt % | | | | | | |
| Vacuum Resid | 100 | — | — | — | — | — |
| Extract | — | 100 | — | — | — | — |
| Air-blown Extract (1) | — | — | 100 | 90 | 80 | 70 |
| Pyrolysis Tar | — | — | — | 10 | 20 | 30 |
| Coke Yield, wt % | 15.9 | 27.1 | 34.0 | 35.2 | 36.2 | 37.0 |
| Coke Sulfur Content, wt % | 1.24 | 1.26 | 1.17 | 1.10 | 0.95 | 0.85 |
| Axial CTE (2), $19^{-7}$/°C. | 5.9 | 7.6 | 44.0 | 33.6 | 32.1 | 27.4 |
| Transverse/Axial CTE Ratio (2) | 6.0 | 3.0 | 1.1 | 1.3 | 1.3 | 1.4 |

(1) Laboratory air blown to a softening point > 90° C.
(2) Calculated from X-ray crystallinity data. Corresponds to CTEs or CTE ratios at 65° C.

From the above data, it can be seen that the coke yield increases substantially when only the solvent extract portion of the vacuum resid is coked (from 15.9 to 27.1 wt %), while the difference in coke sulfur contents is insignificant. The coke also becomes slightly less anisotropic (transverse-to-axial CTE ratio dropping from 6.0 to 3.0), but it does not become isotropic (CTE ratio less than about 1.5 at 65° C.). Air blowing the extract, however, not only increases the coke yield (from 27.1 to 34.0 wt %) but also makes the coke isotropic (CTE ratio = 1.1).

Runs 4-6 show the beneficial effect of blending a low-sulfur pyrolysis tar with the air-blown extract prior to coking. Adding the tar up to a percentage of 30 wt % in the coker feedstock increases the coke yield from 34.0 up to 37.0 wt % while reducing the coke sulfur from 1.17 to 0.85 wt %. The degree of isotropy of the coke is lessened slightly (from 1.1 CTE ratio to 1.4) but remains in the isotropic range.

In commercial operations, the use of solvent extraction prior to air blowing and coking would have a decided advantage over air blowing the whole vacuum resid. The extract volume is typically about half that of the whole resid, thereby reducing the quantity of stock that needs to be air blown. More importantly, if the resid is a source of lubricating oils, the extraction step recovers the valuable lube oil portions in the raffinate phase and allows the less valuable portions remaining in the extract to be processed in an air-blowing unit prior to coking.

While certain embodiments and details have been shown for the purpose of illustrating the present invention, it will be apparent to those skilled in the art that various changes and modifications may be made herein without departing from the spirit and/or scope of the invention.

I claim:

1. A process for obtaining isotropic coke which comprises:

(a) combining from about 15 to about thirty percent (30%) by weight of a pyrolysis tar containing from about 0.1 weight percent sulfur to about 2 weight percent sulfur and from about 70 to about 85% of a residual oil of higher sulfur content than the pyrolysis tar which has been solvent extracted to remove paraffinic components and has been contacted with an oxygen-containing gas at an elevated temperature to increase its softening point, and (b) subjecting the combined material to delayed coking to obtain an isotropic coke having a transverse-to-axial coefficient of thermal expansion ratio less than about 1.5 and a sulfur content not greater than about 1.5 weight percent.

2. The process of claim 1 in which the residual oil is a lube residual oil.

3. The process of claim 2 in which the oxygen-containing gas is air.

4. A process for producing low-sulfur isotropic coke which comprises:

(a) subjecting a lube residual oil to solvent extraction, (b) subjecting the extract from the solvent extraction, which is reduced in paraffinic components, to contact with from about 15 to about 30% by weight of an oxygen-containing gas at an elevated temperature to increase its softening point, (c) combining from about 70 to about 85% by weight of the oxygen-treated extract with a pyrolysis tar, and (d) subjecting the combined material to delayed coking to obtain an isotropic coke having a transverse-to-axial coefficient of thermal expansion ratio less than about 1.5 and a sulfur content not greater than about 1.5 weight percent.

5. The process of claim 4 in which the oxygen-containing gas is air.

6. The process of claim 5 in which the contact with the oxygen-containing gas is carried out with an air ratio of between about 20 and about 100 SCF per minute per ton of extract and at a temperature between about 400° and about 600° F. to raise the softening point of the extract to between about 120 and about 240° F.

7. The process of claim 6 in which the delayed coking is carried out at a temperature between about 830° and about 950° F. and a pressure between about 15 and about 200 psig for a time period of between about 8 and about 100 hours.

* * * * *

UNITED STATES PATENT AND TRADEMARK OFFICE

CERTIFICATE OF CORRECTION

PATENT NO. : 5,092,982

DATED : March 3, 1992

INVENTOR(S) : Lloyd G. Becraft

It is certified that error appears in the above–identified patent and that said Letters Patent is hereby corrected as shown below:

Column 1, line 16, "1.0.1.5" should be --1.0-1.5--.

Column 2, line 26, after "general" insert a comma.

Column 2, line 27, after "propylene" insert a comma.

Claim 4, Column 7, line 24 through Column 8, line 1, the words --with from about 15 to about 30% by weight of-- should be deleted and reinserted in Claim 4 at Column 8, line 4 after "with".

Signed and Sealed this

Twenty-fifth Day of May, 1993

*Attest:*

Michael K. Kirk

MICHAEL K. KIRK

*Attesting Officer*

*Acting Commissioner of Patents and Trademarks*